US009607575B2

(12) United States Patent
Wang

(10) Patent No.: US 9,607,575 B2
(45) Date of Patent: Mar. 28, 2017

(54) DISPLAY MODE ADJUSTING METHOD OF DISPLAY DEVICE AND DISPLAY MODE ADJUSTING MODULE THEREOF

(71) Applicant: ASUSTeK COMPUTER INC., Taipei (TW)

(72) Inventor: Chih-Jung Wang, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 401 days.

(21) Appl. No.: 14/276,746

(22) Filed: May 13, 2014

(65) Prior Publication Data

US 2014/0333656 A1 Nov. 13, 2014

Related U.S. Application Data

(60) Provisional application No. 61/822,449, filed on May 13, 2013.

(30) Foreign Application Priority Data

Apr. 1, 2014 (CN) ..... 2014 1 0129163

(51) Int. Cl.
*G09G 5/02* (2006.01)
*G09G 5/10* (2006.01)

(52) U.S. Cl.
CPC ..... *G09G 5/02* (2013.01); *G09G 5/10* (2013.01); *G09G 2320/0626* (2013.01);
(Continued)

(58) Field of Classification Search
CPC ..... G06T 7/408; H04N 1/46; H04N 13/0257; G09G 5/02
See application file for complete search history.

(56) References Cited

U.S. PATENT DOCUMENTS 5,283,671 A 2/1994 Stewart et al.
7,583,838 B2 * 9/2009 Lee ..... G09G 5/02 382/167

(Continued)

FOREIGN PATENT DOCUMENTS

CN 1578384 2/2005
CN 201174228 12/2008

(Continued)

*Primary Examiner* — Phi Hoang
(74) *Attorney, Agent, or Firm* — Muncy, Geissler, Olds & Lowe, P.C.

(57) ABSTRACT

A display mode adjusting method and a display mode adjusting module executing the adjusting method are provided. The method includes the following steps: generating a saturation adjusting output color according to an input color to adjust the saturation; obtaining a relative color temperature adjusting parameter according to a target color temperature and an original optical characteristic of a display device; generating a color temperature adjusting output color according to the saturation adjusting output color and the relative color temperature adjusting parameter to adjust the color temperature; obtaining a brightness adjustment value according to the brightness of ambient light to adjust the brightness. Therefore, the display mode of the display device is adjusted to suitable for reading, which avoids the eyestrain when the users read for a long time.

9 Claims, 12 Drawing Sheets

(52) U.S. Cl.
CPC . *G09G 2320/0666* (2013.01); *G09G 2340/14* (2013.01); *G09G 2360/144* (2013.01)

(56) References Cited

U.S. PATENT DOCUMENTS

| | | | | |
|---|---|---|---|---|
| 2002/0060759 | A1* | 5/2002 | Kim | G02F 1/133604 349/70 |
| 2005/0219380 | A1* | 10/2005 | Wu | H04N 9/735 348/223.1 |
| 2007/0133867 | A1* | 6/2007 | Park | H04N 1/6027 382/162 |
| 2010/0033457 | A1 | 2/2010 | Kim et al. | |
| 2014/0198084 | A1* | 7/2014 | Peana | G09G 3/3406 345/207 |

FOREIGN PATENT DOCUMENTS

| | | | | |
|---|---|---|---|---|
| CN | 102111626 | | 6/2011 | |
| CN | 102271259 | | 12/2011 | |
| JP | WO2009/142299 | * | 11/2009 | H04N 1/6027 |

* cited by examiner

DISPLAY MODE ADJUSTING METHOD OF DISPLAY DEVICE AND DISPLAY MODE ADJUSTING MODULE THEREOF

CROSS-REFERENCE TO RELATED APPLICATION

This application claims the priority benefit of CN application serial No. 201410129163. X, filed on Apr. 1, 2014 and U.S. provisional application Ser. No. 61/822,449, filed on May 13, 2013. The entirety of the above-mentioned patent application is hereby incorporated by reference herein and made a part of specification.

BACKGROUND OF THE INVENTION

Field of the Invention

The invention relates to a display device.

Description of the Related Art

As the information technology develops, a display device, such as a desktop computer, a table computer, and a smart phone is usually used to read, play games or watch movie, which becomes to be a main way to get information or have leisure activities for users.

However, since a display mode of the display device presents the display colors in red, green, blue (RGB) color gamut conventionally, which easily causes the eyestrain if the users read or view a screen for a long time.

BRIEF SUMMARY OF THE INVENTION

A display mode adjusting method of a display device is provided, and it includes the following steps: receiving a set of input color and obtaining a saturation adjusting parameter according to a hue of the set of input color; generating a set of saturation adjusting output color according to the set of input color and the saturation adjusting parameter; receiving a target color temperature and obtaining a set of relative color temperature adjusting parameter according to the target color temperature and an original optical characteristic of the display device; obtaining a set of color temperature adjusting output color according to the set of saturation adjusting output color and the set of relative color temperature adjusting parameter; obtaining a brightness adjustment value according to the brightness of ambient light; and changing a saturation, a color temperature and a brightness of the display device according to the set of saturation adjusting output color, the set of color temperature adjusting output color and the brightness adjustment value.

A display mode adjusting module of a display device is further provided, and it includes a saturation adjusting unit, a color temperature adjusting unit and a brightness adjusting unit. The saturation adjusting unit obtains a set of saturation adjusting output color according to a set of input color and a saturation adjusting parameter, and the saturation adjusting unit changes a saturation of the display device according to the set of saturation adjusting output color. The color temperature adjusting unit receives a target color temperature, and obtains a set of relative color temperature adjusting parameter according to the target color temperature and an original optical characteristic of the display device, and the color temperature adjusting unit further obtains a set of color temperature adjusting output color according to the set of saturation adjusting output color and the set of relative color temperature adjusting parameter, so as to change a color temperature of the display device. The brightness adjusting unit obtains a brightness adjustment value according to the brightness of ambient light, and the brightness adjusting unit changes a brightness of the display device according to the brightness adjustment value.

Consequently, the display mode adjusting method and the display mode adjusting module thereof integrate the adjustments of the saturation, the color temperature and the brightness of the screen, and a display mode of the display device is adjusted to a mode which is suitable for reading. The display mode suitable for reading is taken as an example, the RGB color light of the display device simulate to present cyan, magenta, yellow, and key black (CMYK) color gamut of a presswork, so as to provide a suitable display mode for reading, which avoids the eyestrain when the user reads for a long time.

DETAILED DESCRIPTION OF THE EMBODIMENTS

A display mode adjusting method of a display device is illustrated with relating figures, and the same symbols denote the same components.

Figure 1:
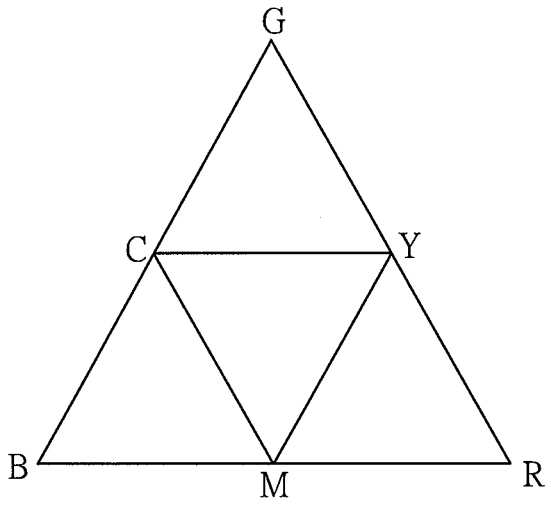
FIG. 1 is a schematic diagram showing a relative relation between RGB color gamut presented in a display device and CMYK color gamut of a presswork in the same color gamut space.

Please refer to FIG. 1, FIG. 1 is a schematic diagram showing a relative relation between RGB color gamut presented in a display device and CMYK color gamut of a presswork in the same color gamut space. The display device may be a liquid crystal display device, an organic light-emitting diode display device, or other flat panel display devices, which is not limited herein.

In the same color gamut space, the color range presented in CMYK color gamut of a common presswork is less than that of RGB color gamut presented in a display device (a triangle area of CMY compares to a triangle area of RGB). Additionally, compare with an image presented in the display device, an image presented in the common presswork is more suitable to read for a long time. Consequently, a display mode adjusting method integrates the adjustments of the saturation, the color temperature and the brightness of the screen, and it utilizes the RGB color light of the display device to simulate to present the CMYK color gamut of the presswork, so as to provide the user a suitable display mode for reading, which avoids the eyestrain when the user reads for a long time.

Figure 2A:
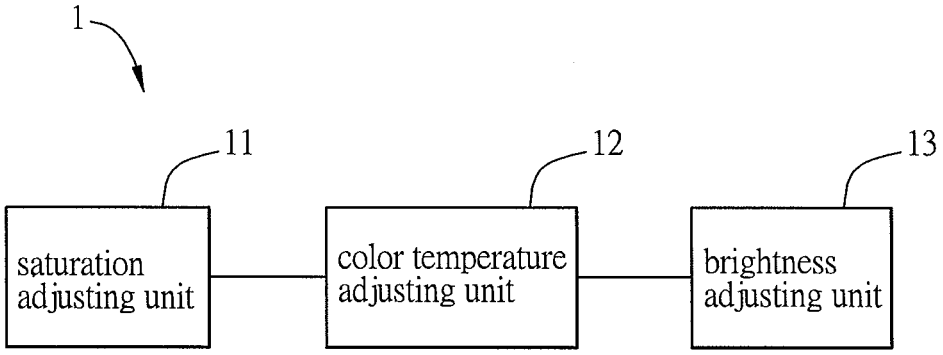
FIG. 2A is a block diagram showing a display mode adjusting module in an embodiment.
Figure 2B:
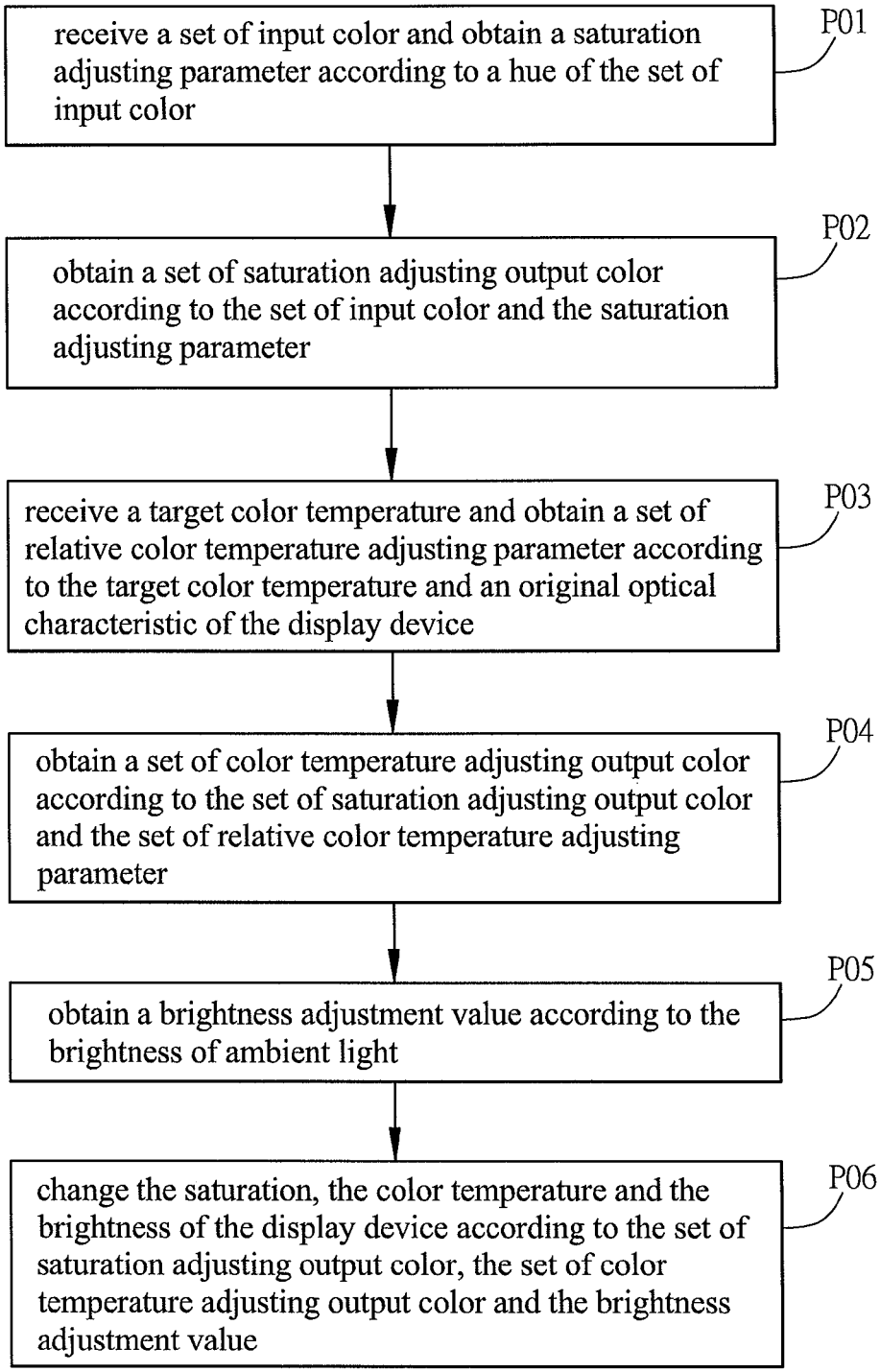
FIG. 2B is a flow chart showing a display mode adjusting method of a display device in an embodiment.

Please refer to FIG. 2A and FIG. 2B. FIG. 2A is a block diagram showing a display mode adjusting module in an embodiment. FIG. 2B is a flow chart showing a display mode adjusting method of a display device in an embodiment.

A display mode adjusting module 1 includes a saturation adjusting unit 11, a color temperature adjusting unit 12 and a brightness adjusting unit 13. The saturation adjusting unit 11, the color temperature adjusting unit 12 and the brightness adjusting unit 13 may be achieved their functions by software, hardware or firmware, which is not limited herein.

As shown in FIG. 2B, a display mode adjusting method includes the step P01 to the step P06.

First, in the step P01, a set of input color ($R_{in}$, $G_{in}$, $B_{in}$) is received, and a saturation adjusting parameter S is obtained according to a hue ($H_{in}$) of the set of input color ($R_{in}$, $G_{in}$, $B_{in}$). The set of input color ($R_{in}$, $G_{in}$, $B_{in}$) may be any color in RGB color gamut presented in the display device. After the saturation adjusting unit 11 obtains the input color ($R_{in}$, $G_{in}$, $B_{in}$), the $H_{in}$ is obtained according to the set of input color ($R_{in}$, $G_{in}$, $B_{in}$), and then a saturation adjusting parameter S corresponding to the $H_{in}$ is obtained. The saturation adjusting parameter S is a function of the $H_{in}$: $S=f_s(H_{in})$, wherein the value of S is between 0 and 2.

Then, in the step P02, a set of saturation adjusting output color ($R_{sat}$, $G_{sat}$, $B_{sat}$) is obtained according to the set of input color ($R_{in}$, $G_{in}$, $B_{in}$) and the saturation adjusting parameter S. After the set of input color ($R_{in}$, $G_{in}$, $B_{in}$) and the saturation adjusting parameter S are inputted to the saturation adjusting unit 11, the saturation adjusting unit 11 obtains saturation adjusting output color ($R_{sat}$, $G_{sat}$, $B_{sat}$) according to the input color ($R_{in}$, $G_{in}$, $B_{in}$) and the saturation adjusting parameter S. The display mode suitable for reading is taken as an example to simulate the effect of the smaller color gamut (CMYK color gamut), the saturation of the saturation adjusting output color ($R_{sat}$, $G_{sat}$, $B_{sat}$) should be less than or equal to the saturation of the input color ($R_{in}$, $G_{in}$, $B_{in}$).

The saturation adjusting unit 11 may include two embodiments hereinafter. In a first embodiment, the saturation adjusting unit 11 is shown as FIG. 3A, the input color ($R_{in}$, $G_{in}$, $B_{in}$), the saturation adjusting parameter S and the saturation adjusting output color ($R_{sat}$, $G_{sat}$, $B_{sat}$) conform to the following formula:

$$\begin{bmatrix} R_{sat} \\ G_{sat} \\ B_{sat} \end{bmatrix} = [M_{osc}^{-1}]_{3\times3} \begin{bmatrix} 1 & 0 & 0 \\ 0 & S & 0 \\ 0 & 0 & S \end{bmatrix} [M_{osc}]_{3\times3} \begin{bmatrix} R_{in} \\ G_{in} \\ B_{in} \end{bmatrix},$$

wherein $[M_{csc}]$ and $[M_{csc}^{-1}]$ are 3×3 operation matrixes, $[M_{csc}]$ is a color space conversion operation matrix, $[M_{csc}^{-1}]$ is a color space conversion inverse operation matrix (all the conversions of the matrixes in the color spaces presenting brightness and chroma are suitable for the formula, such as YCbCr chromaticity space, YIQ chromaticity space), and $M_{sat}$ is an operation matrix, $$M_{sat} = \begin{bmatrix} 1 & 0 & 0 \\ 0 & S & 0 \\ 0 & 0 & S \end{bmatrix}.$$

Figure 3A:
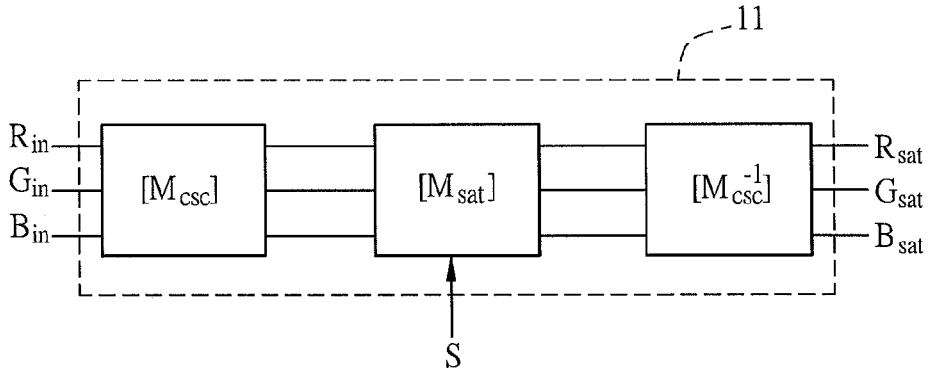
FIG. 3A and FIG. 3B are schematic diagrams showing a saturation adjusting unit in FIG. 2A in different embodiments.
Figure 3B:
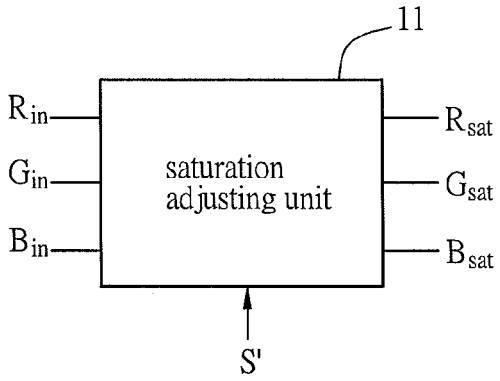

Additionally, in a second embodiment, the saturation adjusting unit 11 is shown as FIG. 3B, it includes a saturation adjusting unit built in a display adapter of a display device. First, the saturation adjusting parameter S is converted to a format needed for a saturation color adjusting unit built in the display adapter, that is, $S'=f_s'(S)$. Then, the saturation adjusting output color ($R_{sat}$, $G_{sat}$, $B_{sat}$) is obtained according to the input color ($R_{in}$, $G_{in}$, $B_{in}$) and the saturation adjusting parameter S'. As a result, the output saturation of the display screen is adjusted.

Then, in the step P03, a target color temperature T is received, and a set of relative color temperature adjusting parameter ($R_{coeff}$, $G_{coeff}$, $B_{coeff}$) is obtained according to the target color temperature T and an original optical characteristic of the display device (such as tristimulus values of the original brightest red, brightest green and brightest blue of the display device). The display mode suitable for reading is taken as an example, the display is adjusted to have warm color temperature, and then the color temperature of the adjusted display screen is warmer than the unadjusted color temperature, so as to increase comfort in reading. In addition, in the relative color temperature adjusting parameter, $R_{coeff}$ is the relative color temperature adjusting parameter of red, $G_{coeff}$ is the relative color temperature adjusting parameter of green, $B_{coeff}$ is the relative color temperature adjusting parameter of blue.

Figure 4A:
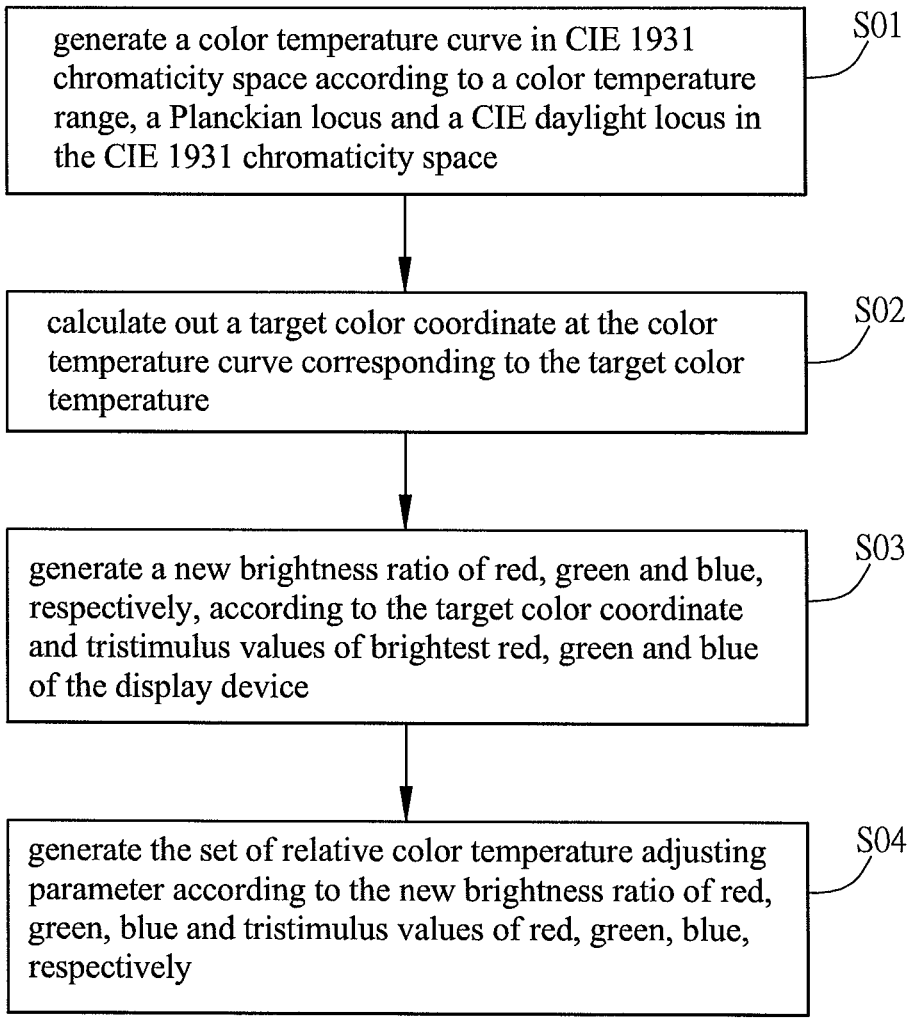
FIG. 4A is a flow chart showing a method of obtaining a relative color temperature adjusting parameter in an embodiment.
Figure 4B:
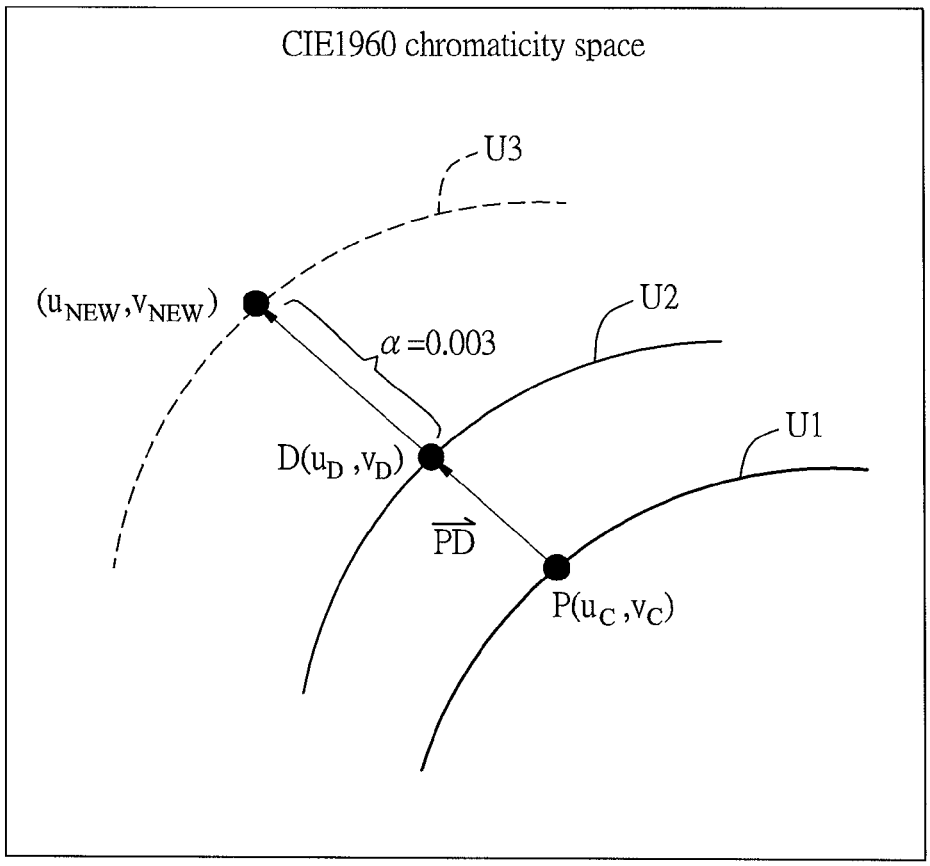
FIG. 4B is an enlarged view showing a Planckian locus, a daylight locus and a new defined color temperature curve in the CIE 1960 chromaticity space in an embodiment.
Figure 4C:
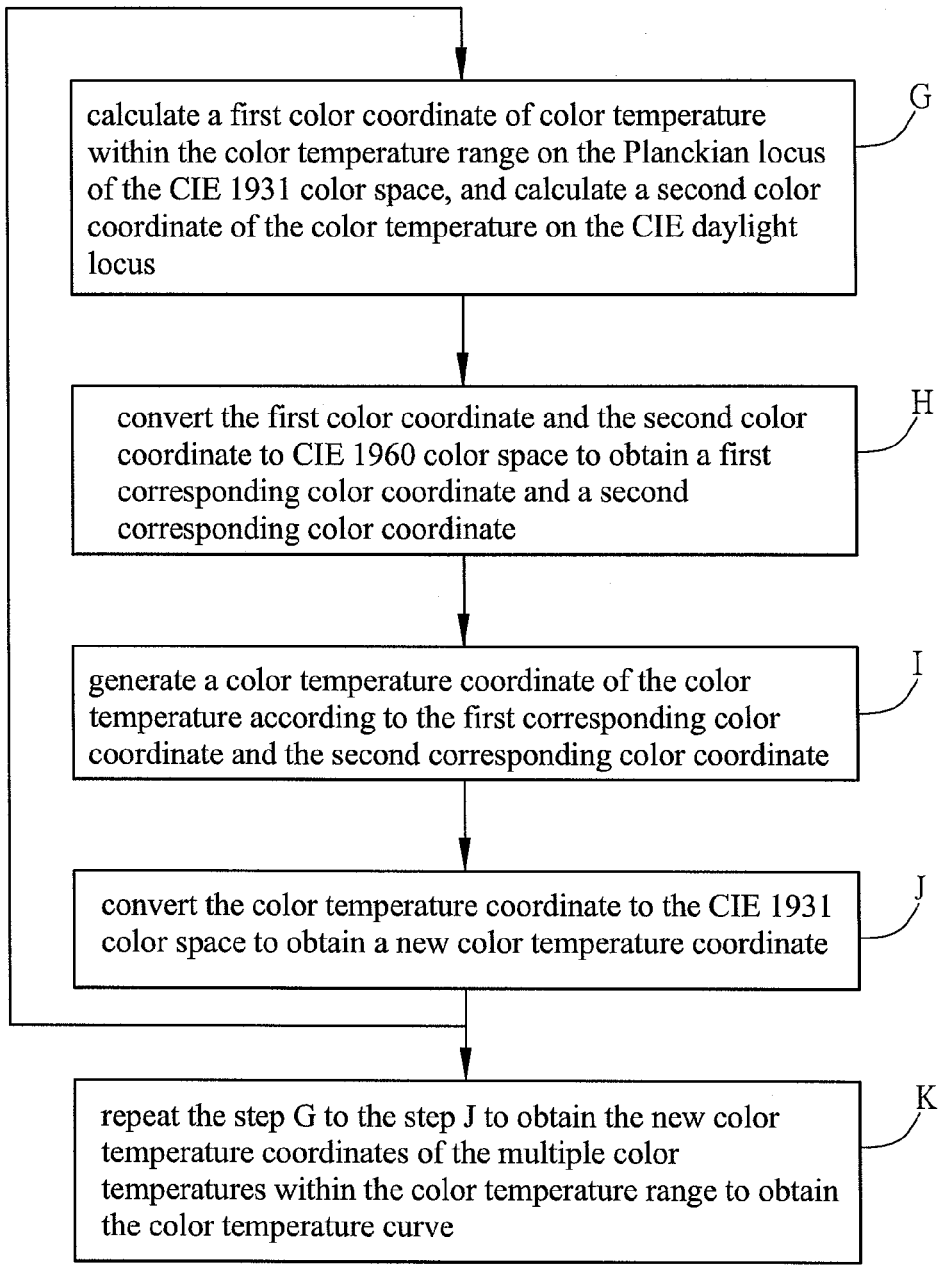
FIG. 4C is a flow chart of generating a new color temperature curve in an embodiment.
Figure 4D:
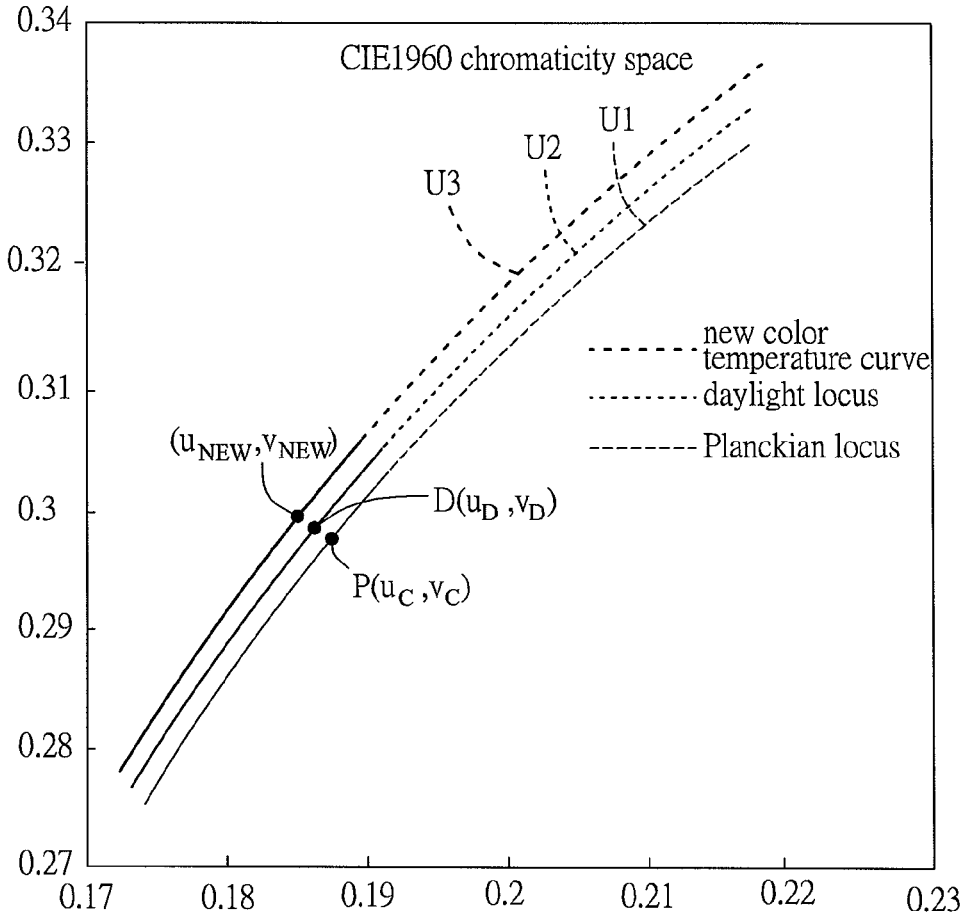
FIG. 4D is a relative schematic diagram showing a Planckian locus, a daylight locus and a new color temperature curve in the CIE 1960 chromaticity space in an embodiment.
Figure 4E:
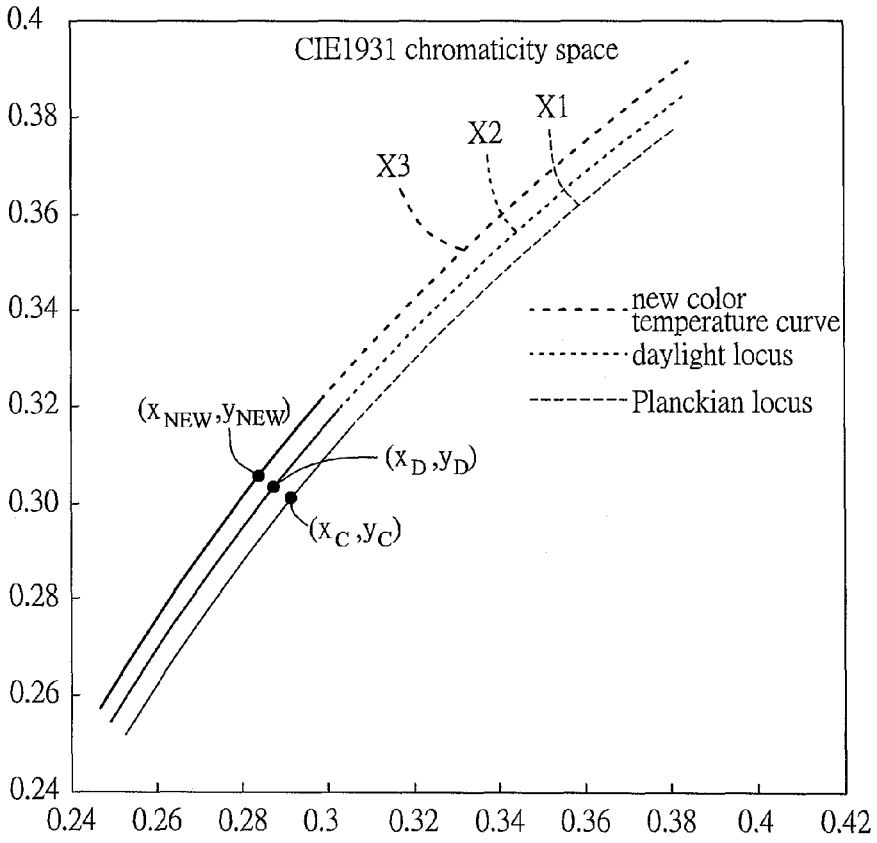
FIG. 4E is a relative schematic diagram showing a Planckian locus, a daylight locus and a new color temperature curve in the CIE 1931 chromaticity space.

As how to the relative color temperature adjusting parameter ($R_{coeff}$, $G_{coeff}$, $B_{coeff}$), please refer to FIG. 4A to FIG. 4E. FIG. 4A is a flow chart showing a method of obtaining a relative color temperature adjusting parameter in an embodiment. FIG. 4B is an enlarged view showing a Planckian locus, a daylight locus and a new defined color temperature curve (hereafter that is the new color temperature curve) in the commission internationale de l'eclairage (CIE) 1960 chromaticity space in an embodiment. FIG. 4C is a flow chart of generating a new color temperature curve in an embodiment. FIG. 4D is a relative schematic diagram showing a Planckian locus, a daylight locus and a new color temperature curve in the CIE 1960 chromaticity space in an embodiment. FIG. 4E is a relative schematic diagram showing a Planckian locus, a daylight locus and a new color temperature curve in the CIE 1931 chromaticity space.

As shown in FIG. 4A, the steps of the color temperature adjusting unit 12 obtaining the set of relative color temperature adjusting parameter include the step S01 to the step S04. First, in the step S01, a color temperature curve is generated in the CIE 1931 chromaticity space according to a color temperature range, a Planckian locus and a CIE daylight locus in the CIE 1931 chromaticity space. In the embodiment, the color temperature range is between 4000K and 25000K (which means "4000K≤the color temperature≤25000K", and the color temperature is in Kelvin as the unit). In other words, in order to conform to the visual feel of a common user, the color temperature adjusting unit 12 does not define a color coordinate of the target color temperature on the Planckian locus or the CIE daylight locus in the CIE 1931 chromaticity space. Instead, the color temperature adjusting unit 12 defines a new color temperature curve according to the two curves, and the new color temperature curve more conforms to the visual feel of users.

FIG. 4B to FIG. 4E shows how to generate a new color temperature curve. The steps of generating the new color temperature curve include the step G to the step K.

As shown in FIG. 4C, first, in step G, on the Planckian locus X1 in the CIE 1931 chromaticity space, a first color coordinate ($x_C$, $y_C$) of a color temperature within the color temperature range is calculated, and a second color coordinate ($x_D$, $y_D$) of the color temperature on the CIE daylight locus X2 is calculated. In detail, as shown in FIG. 4E, in order to obtain the new color temperature curve X3 in the CIE 1931 chromaticity space, an initial sampling point, such as 4000K (which can also be 25000K or other values), is sampled within the color temperature range (which is between 4000K and 25000K), and the color temperature T in 4000K is converted to the first color coordinate ($x_C$, $y_C$) on the Planckian locus X1 and the second color coordinate ($x_D$, $y_D$) on the CIE daylight locus X2 in the CIE 1931 chromaticity space. The conversion formula (1) of the first color coordinate ($x_C$, $y_C$) is:

$$x_C=-3.0258469(10^9/T^3)+2.1070379(10^6/T^2)+0.2226347(10^3/T)+0.240390,$$

$$y_C=3.0817580x_c^3-5.87338670x_c^2+3.75112997x_c-0.37001483, \text{ wherein}$$

4000K≤T≤25000K. The conversion formula (2) of the second color coordinate ($x_D$, $y_D$) is:

$$x_D = \begin{cases} 0.244063+0.09911\frac{10^3}{T}+2.9678\frac{10^6}{T^2}-4.6070\frac{10^9}{T^3} & 4000\text{K} \le T \le 7000\text{K} \\ 0.237040+0.24748\frac{10^3}{T}+1.9018\frac{10^6}{T^2}-2.0064\frac{10^9}{T^3} & 7000\text{K} < T \le 25000\text{K} \end{cases}$$

$$y_D = -3.000x_D^2+2.870x_D-0.275$$

After the first color coordinate ($x_C$, $y_C$) and the second color coordinate ($x_D$, $y_D$) are obtained, the step H is executed, as shown in FIG. 4D, the first color coordinate ($x_C$, $y_C$) and the second color coordinate ($x_D$, $y_D$) are converted to the CIE 1960 chromaticity space to obtain a first corresponding color coordinate P(uc, vc) and a second corresponding color coordinate D($u_D$, $v_D$). The conversion formula (3) is:

$$u = \frac{4x}{-2x+12y+3},\ v = \frac{6y}{-2x+12y+3}$$

Then, in the step I, a color temperature coordinate ($u_{New}$, $v_{New}$) of the color temperature is generated according to the first corresponding color coordinate P(uc, vc) and the second corresponding color coordinate D($u_D$, $v_D$). In the embodiment, as shown in FIG. 4B and FIG. 4D, in the step H, the color temperature adjusting unit 12 calculates out the first corresponding color coordinate P(uc, vc) of the color temperature T on the Planckian locus U1 in the CIE 1960 chromaticity space and the second corresponding color coordinate D($u_D$, $v_D$) of the color temperature T on the CIE daylight locus U2. Then, in the step I, the new color temperature coordinate ($u_{New}$, $v_{New}$) of the color temperature T in the CIE 1960 chromaticity space can be obtained by extending along the vector $\overrightarrow{PD}$ from the second corresponding color coordinate D. The calculation formula (4) of the color temperature coordinate ($u_{New}$, $v_{New}$) is:

$$(u_{New}, v_{New}) = D(u_D, v_D) + \alpha\frac{\overrightarrow{PD}}{|\overrightarrow{PD}|} \quad \overrightarrow{PD} = (u_D-u_C, v_D-v_C) \quad |PD| = \sqrt{(u_D-u_C)^2+(v_D-v_C)^2}$$

Wherein P(uc,vc) is the first corresponding color coordinate, D($u_D$,$v_D$) is the second corresponding color coordinate, ($u_{New}$, $v_{New}$) is the new color temperature coordinate, and α is between 0.001 and 0.005. The value of α is preferably 0.003. In other embodiments, the value of α can be adjusted according to different requirements of visual feel.

Then, in the step J, the color temperature coordinate ($u_{New}$, $v_{New}$) is converted to the CIE 1931 chromaticity space to obtain a new color temperature coordinate ($x_{New}$, $y_{New}$). As shown in FIG. 4E, the color temperature adjusting unit 12 converts the color temperature coordinate ($u_{New}$, $v_{New}$) in the CIE 1960 chromaticity space to the CIE 1931 chromaticity space by using the formula (3) to obtain the new color temperature coordinate ($x_{New}$, $y_{New}$).

Finally, the step K is executed, the step G to the step J are repeated to obtain the new color temperature coordinates ($x_{New}$, $y_{New}$) of multiple color temperatures within the color temperature range, so as to obtain the color temperature curve X3. The color temperature adjusting unit 12 obtains different color temperature values according to an interval sampling value, and further obtains the corresponding new color temperature coordinates ($x_{New}$, $y_{New}$). In other words, 10K may be taken as the interval sampling value, and the step G to the step K are repeated at the color temperature of 4010K, 4020K, 4030K . . . 25000K, respectively. Thus, the multiple corresponding new color temperature coordinates ($x_{New}$, $y_{New}$) in the CIE 1931 chromaticity space are obtained, and they are connected to form a curve, which is the color temperature curve X3 in the step S01. The interval sampling value 10K is just an example. The interval sampling value may be a different value (such as 1K) in other embodiments, and the smaller the interval sampling value is, the more precise the color temperature curve X3 is.

Consequently, after the new color temperature curve X3 (shown in FIG. 4E) in the CIE 1931 chromaticity space is generated according to the Planckian locus X1 and the CIE daylight locus X2 in the CIE 1931 chromaticity space. Please refer to FIG. 4A, in the step S02, a target color coordinate ($x_{tw}$, $y_{tw}$) (not shown) at the color temperature curve X3 corresponding to a target color temperature is calculated out. The color temperature adjusting unit 12 converts the target color temperature to get the corresponding target color coordinate ($x_{tw}$, $y_{tw}$) in the CIE 1931 chromaticity space via the new color temperature curve X3 according to the step G to the step J. The target color temperature is the color temperature of an image to be displayed by the display device, and the target color temperature is still between 4000K and 25000K.

In the step S03, a new brightness ratio of red, green and blue is generated, respectively, according to the target color coordinate ($x_{tw}$, $y_{tw}$) and tristimulus values of brightest red (R), brightest green (G) and brightest blue (B) of the display device. The tristimulus values X, Y, Z of the original brightest red, brightest green and brightest blue of the display device are converted to the color coordinates (x, y) in the CIE 1931 chromaticity space, respectively, via the formula (5), and then the new brightness ratios of red, green and blue are calculated out via the color coordinates (x, y) and the target color coordinate ($x_{tw}$, $y_{tw}$) of the target color temperature according to the formula (6). The tristimulus values of brightest red, brightest green and brightest blue of the display device are ($X_R$, $Y_R$, $Z_R$), ($X_G$, $Y_G$, $Z_G$), ($X_B$, $Y_B$, $Z_B$), respectively. The formula (5) is: x=X/(X+Y+Z), y=Y/(X+Y+Z), and the formula (6) of the new brightness ratio of the target color temperature ("R" and "r" represent red, "G" and "g" represent green and "B" and "b" represent blue) is:

$$Ratio_R : Ratio_G : Ratio_B = \left|\begin{matrix} \frac{x_{tw}-x_g}{y_g} & \frac{x_{tw}-x_b}{y_b} \\ \frac{y_{tw}-y_g}{y_g} & \frac{y_{tw}-y_b}{y_b} \end{matrix}\right| : \left|\begin{matrix} \frac{x_{tw}-x_b}{y_b} & \frac{x_{tw}-x_r}{y_r} \\ \frac{y_{tw}-y_g}{y_g} & \frac{y_{tw}-y_r}{y_r} \end{matrix}\right| : \left|\begin{matrix} \frac{x_{tw}-x_r}{y_r} & \frac{x_{tw}-x_g}{y_g} \\ \frac{y_{tw}-y_r}{y_r} & \frac{y_{tw}-y_g}{y_g} \end{matrix}\right|$$

After the new brightness ratio is obtained, in the step S04, a set of relative color temperature adjusting parameter ($R_{coeff}$, $G_{coeff}$, $B_{coeff}$) is generated, respectively, according to the new brightness ratios and the tristimulus values of red, green and blue. The set of relative color temperature adjusting parameter ($R_{coeff}$, $G_{coeff}$, $B_{coeff}$) is obtained via the following formulas, wherein $R_{coeff}$ (shown as "$Coef_R$" in the formulas) is the relative color temperature adjusting parameter of red, $G_{coeff}$, (shown as "$Coef_G$" in the formulas) is the relative color temperature adjusting parameter of green, $B_{coeff}$ (shown as "$Coef_B$" in the formulas) is the relative color temperature adjusting parameter of blue, and "m" is a screen characteristic parameter of the display device, $$Coef_i = \left(\frac{Y_i'}{Y_i}\right)^{\frac{1}{m}} \quad i \in \{R, G, B\} \quad Y_i' = A_{min} \times i_{ratio}$$

$$A_{min} = \mathrm{Min}\left(\frac{Y_R}{Ratio_R}, \frac{Y_G}{Ratio_G}, \frac{Y_B}{Ratio_B}\right)$$

Figure 5A:
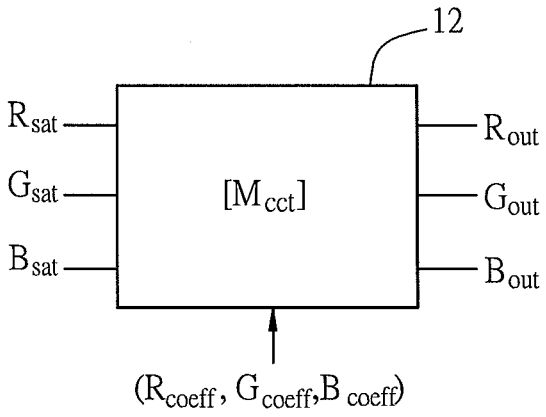
FIG. 5A and FIG. 5B are schematic diagrams showing a color temperature adjusting unit of FIG. 2A in different embodiments.

After the color temperature adjusting unit 12 obtains the set of relative color temperature adjusting parameter ($R_{coeff}$, $G_{coeff}$, $B_{coeff}$), then, please refer to FIG. 2B, in the step P04, a set of color temperature adjusting output color ($R_{out}$, $G_{out}$, $B_{out}$) is obtained according to the saturation adjusting output color ($R_{sat}$, $G_{sat}$, $B_{sat}$) and the set of relative color temperature adjusting parameter ($R_{coeff}$, $G_{coeff}$, $B_{coeff}$). The color temperature adjusting unit 12 may include two embodiments hereinafter. In a first embodiment, the color temperature adjusting unit 12 is as shown in FIG. 5A, the saturation adjusting output color ($R_{sat}$, $G_{sat}$, $B_{sat}$), the relative color temperature adjusting parameter ($R_{coeff}$, $G_{coeff}$, $Bc_{oeff}$) and the color temperature adjusting output color ($R_{out}$, $G_{out}$, $B_{out}$) conform to the following formula:

$$\begin{bmatrix} R_{out} \\ G_{out} \\ B_{out} \end{bmatrix} = \begin{bmatrix} R\ coeff & 0 & 0 \\ 0 & G\ coeff & 0 \\ 0 & 0 & B\ coeff \end{bmatrix} \begin{bmatrix} R_{sat} \\ G_{sat} \\ B_{sat} \end{bmatrix}.$$

Figure 5B:
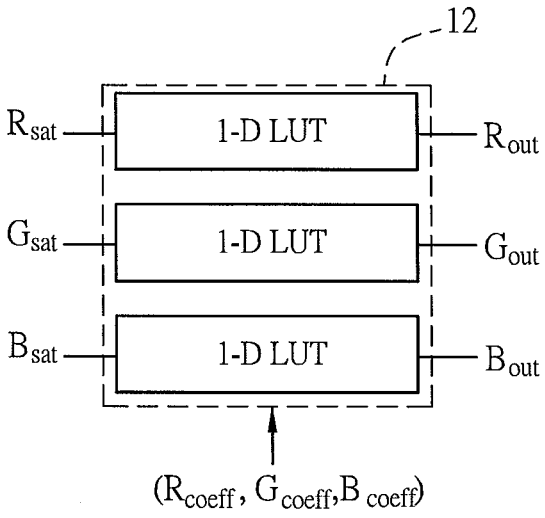

In addition, in a second embodiment, as shown in FIG. 5B, the color temperature adjusting unit 12 is a look-up table (LUT) of red, green and blue of a display adapter built in the display device. The calculation formula of red, green and blue is:

$$R_{out}(i)=\mathrm{LUT}_R(i)=R_{coeff}\times R_{sat}(i), \text{ where } i=1, 2, \ldots, 255,$$

$$G_{out}(i)=\mathrm{LUT}_G(i)=G_{coeff}\times G_{sat}(i), \text{ where } i=1, 2, \ldots, 255,$$

$$B_{out}(i)=\mathrm{LUT}_B(i)=B_{coeff}\times B_{sat}(i), \text{ where } i=1, 2, \ldots, 255.$$

Figure 6A:
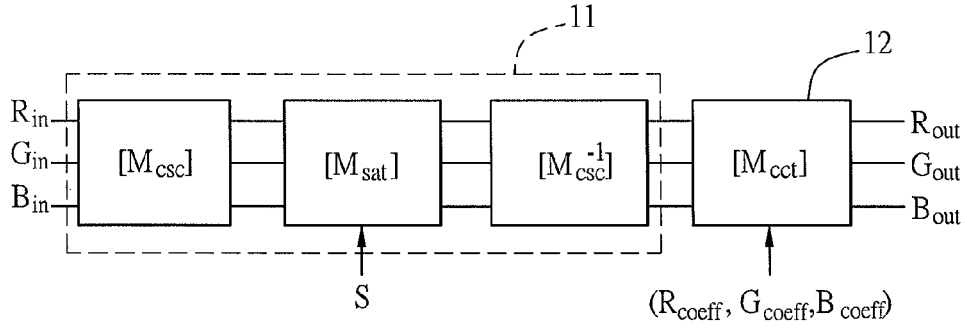
FIG. 6A to FIG. 6D are schematic diagrams showing different combinations of a saturation adjusting unit and a color temperature adjusting unit of FIG. 2A.
Figure 6B:
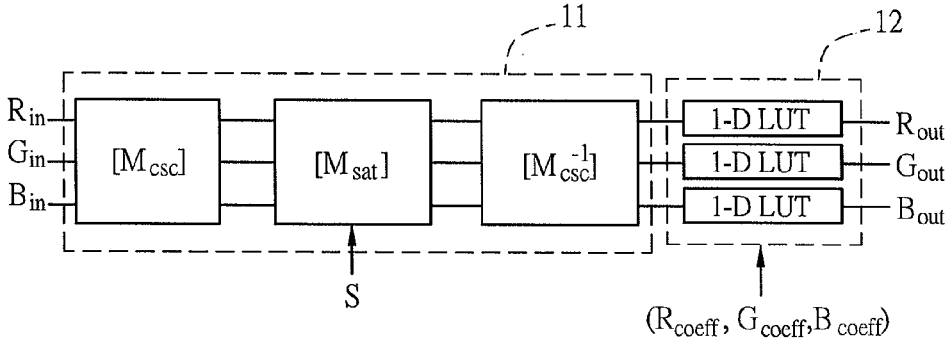
Figure 6C:
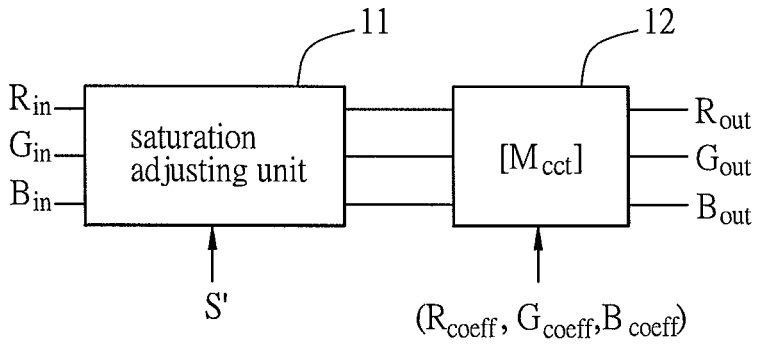
Figure 6D:
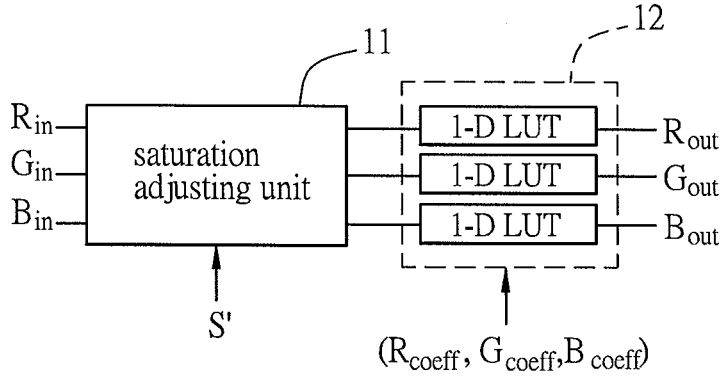

Since the saturation adjusting unit 11 and the color temperature adjusting unit 12 include two embodiments, respectively, the saturation adjusting unit 11 and the color temperature adjusting unit 12 include four different combinations as shown in FIG. 6A to FIG. 6D. FIG. 6A is the combination of FIG. 3A and FIG. 5A, FIG. 6B is the combination of FIG. 3A and FIG. 5B, FIG. 6C is the combination of FIG. 3B and FIG. 5A, FIG. 6D is the combination of FIG. 3B and FIG. 5B.

Figure 7:
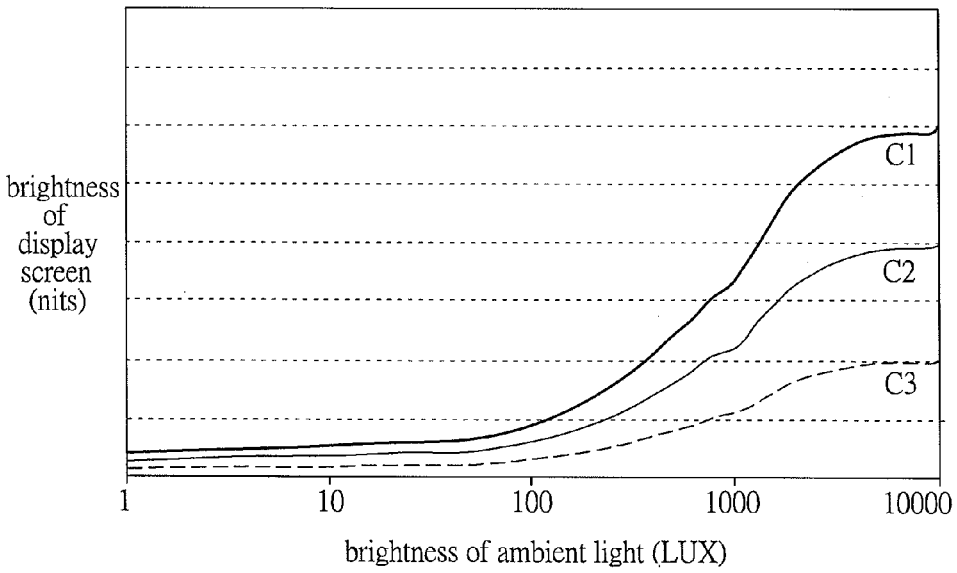
FIG. 7 is a schematic diagram showing a relation of the brightness of ambient light with different gain values and a display screen.

Additionally, please refer to FIG. 2A, FIG. 2B and FIG. 7, in the step P05, a brightness adjustment value is obtained according to the brightness of ambient light. A brightness adjusting curve is generated between the brightness of the ambient light and the brightness of the display screen via the brightness adjusting unit 13. The brightness of the display screen of the display device is positively correlated with the brightness of the ambient light. In addition, the brightness adjusting unit 13 adjusts the brightness of the screen to suitable for reading according to the ambient light of different brightness, so as to reduce the brightness difference between the screen and the ambient light, which avoids the eyestrain when the users watch the screen. The brighter the ambient light is, the brighter the screen is; and the darker the ambient light is, the darker the screen is, and then a base curve $B_{base}$ is generated: $B_{base}(i)=f_{nits}(A(i))$, A(i) represents the ambient light, $B_{base}$ represents the base brightness of the screen corresponding to the ambient light. Further, since the user has different taste on the brightness of the screen, in the embodiment, a gain value G is defined, and then the brightness curve of the screen corresponding to the ambient light is $B(i)=G\times B_{base}(i)$. As shown in FIG. 7, FIG. 7 shows three brightness adjusting curves C1~C3 of the different gain values G the users can choose the different brightness adjusting curve according to the requirements. Therefore, the brightness adjustment value is obtained via the brightness adjusting unit 13 by sensing the actual ambient light when one of the brightness adjusting curves is selected.

Finally, in the step P06, a saturation, a color temperature and a brightness of the display device are changed according to the set of saturation adjusting output color ($R_{sat}$, $G_{sat}$, $B_{sat}$), the set of color temperature adjusting output color ($R_{out}$, $G_{out}$, $B_{out}$) or the brightness adjustment value. The saturation of the display device is changed via the saturation adjusting unit 11 according to the set of saturation adjusting output color ($R_{sat}$, $G_{sat}$, $B_{sat}$), further the color temperature of the display device is changed via the color temperature adjusting unit 12 according to the set of color temperature adjusting output color ($R_{out}$, $G_{out}$, $B_{out}$), and the brightness of the display device is changed via the brightness adjusting unit 13 according to the brightness adjustment value, thus the adjustments of the saturation, the color temperature and the brightness of the display device are finished. In the step of adjusting the saturation, the color temperature, and the brightness, the saturation is first adjusted (the saturation adjusting output color ($R_{sat}$, $G_{sat}$, $B_{sat}$) is first obtained), and then color temperature is adjusted (the color temperature adjusting output color ($R_{out}$, $G_{out}$, $B_{out}$) is obtained secondly), however, the adjustment of the brightness is not necessarily after the adjustment of the saturation or the color temperature, the brightness of the display screen can be first adjusted, and then the saturation and color temperature are adjusted, which is not limited herein.

In sum, in the display mode adjusting method and the display mode adjusting module thereof, the display mode adjusting method includes the following steps: receiving the set of input color and obtaining the saturation adjusting parameter according to the hue of the set of input color; generating the set of saturation adjusting output color according to the set of input color and the saturation adjusting parameter; receiving the target color temperature and obtaining the set of relative color temperature adjusting parameter according to the target color temperature and the original optical characteristic of the display device, so as to generate the set of color temperature adjusting output color; obtaining the brightness adjustment value according to the brightness of the ambient light, so as to change the output brightness of the display device; adjusting the saturation, the color temperature, and the brightness of the display device according to the set of saturation adjusting output color, the set of color temperature adjusting output color and the brightness adjustment value. Consequently, the display mode adjusting method and the display mode adjusting module integrate the adjustments of the saturation, the color temperature and the brightness of the screen, and it utilizes the RGB color light of the display device to simulate to present CMYK color gamut of a presswork, so as to provide the user a suitable display mode for reading, which avoids the eyestrain when the user reads for a long time.

Although the invention has been disclosed with reference to certain preferred embodiments thereof, the disclosure is not for limiting the scope. Persons having ordinary skill in the art may make various modifications and changes without departing from the spirit and the scope of the invention. Therefore, the scope of the appended claims should not be limited to the description of the preferred embodiments described above.

What is claimed is:

1. A display mode adjusting method of a display device, comprising:

receiving a set of input color, and obtaining a saturation adjusting parameter according to a hue of the set of input color;

obtaining a set of saturation adjusting output color according to the set of input color and the saturation adjusting parameter;

receiving a target color temperature, and obtaining a set of relative color temperature adjusting parameter according to the target color temperature and an original optical characteristic of the display device;

obtaining a set of color temperature adjusting output color according to the set of saturation adjusting output color and the set of relative color temperature adjusting parameter;

obtaining a brightness adjustment value according to the brightness of ambient light; and changing a saturation, a color temperature and a brightness of the display device according to the set of saturation adjusting output color, the set of color temperature adjusting output color and the brightness adjustment value.

2. The display mode adjusting method according to claim 1, wherein in the step of obtaining the set of saturation adjusting output color, the saturation of the set of saturation adjusting output color is less than or equal to the saturation of the set of input color.

3. The display mode adjusting method according to claim 1, wherein in the step of obtaining the set of saturation adjusting output color, the set of input color, the saturation adjusting parameter and the set of saturation adjusting output color conform to the following formula:

$$\begin{bmatrix} R_{sat} \\ G_{sat} \\ B_{sat} \end{bmatrix} = [M_{csc}^{-1}]_{3\times3} \begin{bmatrix} 1 & 0 & 0 \\ 0 & S & 0 \\ 0 & 0 & S \end{bmatrix} [M_{csc}]_{3\times3} \begin{bmatrix} R_{in} \\ G_{in} \\ B_{in} \end{bmatrix},$$

wherein ($R_{in}$, $G_{in}$, $B_{in}$), is the set of input color, ($R_{sat}$, $G_{sat}$, $B_{sat}$) is the set of saturation adjusting output color, $[M_{csc}]$ is a color space conversion operation matrix, $[M_{csc}^{-1}]$ is a color space conversion inverse operation matrix, and S is the saturation adjusting parameter, and the value of the S is between 0 and 2.

4. The display mode adjusting method according to claim 1, wherein the step of obtaining the set of relative color temperature adjusting parameter includes:

generating a color temperature curve in commission internationale de l'eclairage (CIE) 1931 chromaticity space according to a color temperature range, a Planckian locus and a CIE daylight locus in the CIE 1931 chromaticity space;

calculating out a target color coordinate at the color temperature curve corresponding to the target color temperature;

generating a new brightness ratio of red, green and blue according to the target color coordinate and tristimulus values of brightest red, brightest green and brightest blue of the display device, respectively; and generating the set of relative color temperature adjusting parameter according to the new brightness ratio of red, green and blue and tristimulus values of red, green and blue, respectively.

5. The display mode adjusting method according to claim 4, wherein the step of generating the color temperature curve includes:

calculating a first color coordinate on the Planckian locus of the CTE 1931 chromaticity space corresponding a color temperature within the color temperature range, and calculating a second color coordinate of the color temperature on the CIE daylight locus;

converting the first color coordinate and the second color coordinate to the CIE 1960 chromaticity space to obtain a first corresponding color coordinate and a second corresponding color coordinate;

generating a color temperature coordinate of the color temperature according to the first corresponding color coordinate and the second corresponding color coordinate;

converting the color temperature coordinate to the CIE 1931 chromaticity space to get a new color temperature coordinate; and repeating above steps to obtain the color temperature coordinates of multiple color temperatures within the color temperature range, so as to obtain the color temperature curve.

6. The display mode adjusting method according to claim 5, wherein in the step of generating the color temperature coordinate, the color temperature coordinate conforms to the following formula:

$$(u_{New}, v_{New}) = D(u_D, v_D) + \alpha\frac{\overrightarrow{PD}}{|PD|}$$

$$\overrightarrow{PD} = (U_D - U_C, V_D - V_C)$$

$$|PD| = \sqrt{(U_D - U_C)^2 + (V_D - V_C)^2},$$

wherein $P(u_c,v_c)$ is the first corresponding color coordinate, $D(u_D,v_D)$ is the second corresponding color coordinate, $(u_{New}, v_{New},)$ is the color temperature coordinate, and $\alpha$ is between 0.001 and 0.005.

7. The display mode adjusting method according to claim 1, wherein in the step of obtaining the set of color temperature adjusting output color, the color temperature adjusting output color conform to the following formula:

$$\begin{bmatrix} R_{out} \\ G_{out} \\ B_{out} \end{bmatrix} = \begin{bmatrix} R\ coeff & 0 & 0 \\ 0 & G\ coeff & 0 \\ 0 & 0 & B\ coeff \end{bmatrix} \begin{bmatrix} R_{sat} \\ G_{sat} \\ B_{sat} \end{bmatrix},$$

wherein $(R_{out}, G_{out}, B_{out})$ is the set of color temperature adjusting output color, $(R_{coeff}, G_{coeff}, B_{coeff})$ is the set of relative color temperature adjusting parameter, and $(R_{sat}, G_{sat}, B_{sat})$ is the set of saturation adjusting output color.

8. The display mode adjusting method according to claim 1, wherein in the step of obtaining the set of color temperature adjusting output color, the color temperature adjusting output color conform to the following formula:

$$R_{out}(i)=LUT_R(i)=R_{coeff}\times R_{out}(i), \text{ where } i=1,2,\ldots,255,$$

$$G_{out}(i)=LUT_G(i)=G_{coeff}\times G_{out}(i), \text{ where } i=1,2,\ldots,255,$$

$$B_{out}(i)=LUT_B(i)=B_{coeff}\times B_{out}(i), \text{ where } i=1,2,\ldots,255,$$

wherein $(R_{out}, G_{out}, B_{out})$ is the set of color temperature adjusting output color, $(R_{coeff}, G_{coeff}, B_{coeff})$ is the set of relative color temperature adjusting parameter, $(R_{sat}, G_{sat}, B_{sat})$ is the set of saturation adjusting output color, and LUT is a look-up table of a display adapter of the display device.

9. The display mode adjusting method according to claim 1, wherein in the step of adjusting the brightness of the display device, the brightness of a display screen of the display device is positively correlated with the brightness of the ambient light.

* * * * *